US006848918B2

(12) United States Patent
Chuang

(10) Patent No.: US 6,848,918 B2
(45) Date of Patent: Feb. 1, 2005

(54) PLUG WITH IMPROVED CONDUCTIVE SHEETMETALS

(76) Inventor: Wen-Piao Chuang, 3F, No. 143, Ta-Hua Road, Chung Li (TW)

( * ) Notice: Subject to any disclaimer, the term of this patent is extended or adjusted under 35 U.S.C. 154(b) by 0 days.

(21) Appl. No.: 10/212,805

(22) Filed: Aug. 7, 2002

(65) Prior Publication Data

US 2004/0029424 A1 Feb. 12, 2004

(51) Int. Cl.[7] ..... H01R 4/66
(52) U.S. Cl. ..... 439/106; 439/606; 439/877
(58) Field of Search ..... 439/877–882, 439/736, 695, 686, 606, 106

(56) References Cited

U.S. PATENT DOCUMENTS 4,927,376 A * 5/1990 Dickie ..... 439/484
5,603,638 A * 2/1997 Brown et al. ..... 439/606
5,662,484 A * 9/1997 Blanche ..... 439/106
5,755,820 A * 5/1998 Lan-Jen ..... 439/694

* cited by examiner

*Primary Examiner*—Tho D. Ta
*Assistant Examiner*—James R. Harvey
(74) *Attorney, Agent, or Firm*—Troxell Law Office PLLC

(57) ABSTRACT

A plug having one round-headed copper conductive sheetmetal and two rectangular copper conductive sheetmetals, all contained within injected resin to form a triangle plug with three conductive sheetmetals arranged in triangle protruding forward. The round-headed conductive sheetmetal is punched in one piece with an extended sheetmetal stretched backward and connected to the wire-inlaying end. The two rectangle conductive sheetmetals are punched with the backend stretching upward to form a seamless L-shaped sheetmetal. The backend of the extended sheetmetal is connected with a wire-inlaying end with its opening facing upward, preventing the extended sheetmetals from being damages because of the second twist. With the three conductive sheetmetals wrapped and located at the back of the plug providing a certain degree of strength and each wire-inlaying end being kept in parallel, the wire inlaying process can be completed once.

1 Claim, 4 Drawing Sheets

PLUG WITH IMPROVED CONDUCTIVE SHEETMETALS

FIELD OF THE INVENTION

The present invention is a plug with improved conductive sheetmetals, especially those whose wire-inlaying ends at the rear are kept toward the same directions, allowing the wire inlaying to be completed once.

BACKGROUND OF THE INVENTION

Traditionally, the plugs of appliances with grounding protection are ones with three copper conductive sheetmetals, among which one round-headed conductive sheetmetal and two rectangle conductive sheetmetals are arranged in triangle, forming into a triangle plug.

Please refer to FIG. 1. Traditional plugs 1 include one round-headed conductive sheetmetal 11' and two rectangle conductive sheetmetals 12', 13' wrapped in resin where the round-headed-sheetmetal 11' is located at the back of the plug 1' with its wire-inlaying opening 12' facing upward. The two rectangle conductive sheetmetals 12', 13' are punched with its wire-inlaying ends 122', 132' on the stretched sheetmetal of the wide side facing upward as shown in FIG. 2. Therefore, when the two rectangle conductive sheetmetals 12', 13' are located on the plug 1' with the narrow side erect, the openings of the wire-inlaying ends 122', 132' would face each other inwardly, which is vertical to the wire-inlaying opening 112' of the round-headed conductive sheetmetal 11'. Under the circumstance where the wire-inlaying opening 112' of the round-headed conductive sheetmetal 11' and those 122', 132' of the rectangle conductive sheetmetals 12', 13' appear vertically against each other, the follow-up wire inlaying processing needs to completes the wire inlaying on one end and continue on with other ends in sequences. For small-sized component processing, dividing the wire inlaying processing in batches is time-consuming and labor-consuming as well as unqualified for the benefit of quota production.

Furthermore, in order to solve the above problem that requires batches of wire-inlaying processing, the industry proposed an improved plug with the three wire-inlaying openings on the backend in parallel with one another. This is done by the addition of the twist processing for the wire-inlaying ends 122', 132' of the two rectangle conductive sheetmetals 12', 13'; that is, by twisting the extended sheetmetals 121', 131' of the rectangle conductive sheetmetals 12', 13', the openings of the wire-inlaying ends 122', 132' are in the same direction with the narrow side of the rectangle conductive sheetmetals 12', 13' (Please refer to FIG. 3), allowing the opening of the wire-inlaying ends 112' of the round-headed conductive sheetmetal 11' protruding out of the plug 1' to be in the same direction with the openings of the wire-inlaying ends 122', 132' of the two rectangle conductive sheetmetals 12', 13' to complete the wire inlaying process once.

However, during the twisting of the expanded sheetmetals 121', 131' for the above rectangle conductive sheetmetals 12', 13', a second twist to the formalized extended sheetmetals 121', 131' would damage the material or the copper extended sheetmetals 121', 131', causing cracks at the bending point of the extended sheetmetals 121', 131' or even snaps them into two. This causes deficiencies and thus influences the yield of the production. Still, the extended sheetmetals 121', 131' of the two rectangle conductive sheetmetals 12', 13' being veered prevent people from observing the slight cracks in the material and then produces the deficiencies. The minor cracks around the twist of the extended sheetmetals 121', 131' would make the whole rectangle conductive sheetmetal overheat 12', 13' or causes over high resistance, which in turn threatens our security. This invention neither fits in with the current security policies for plugs nor provides ideal application.

In view of the requirement for the processing convenience for the wire-inlaying ends of the plugs, the requirement for security regulations, the requirement for reducing processing, requirement for enhancing production performance and requirement for deducing production cost, the inventor came out the "plug with improved conductive sheetmetals" for the present invention.

SUMMARY OF THE INVENTION

The plug with improved conductive sheetmetals for the present invention aims at keeping the wire-inlaying ends in parallel, allowing the wire inlaying and fixture of the plug's conductive sheetmetals to be completed at a time.

In the following, the embodiment illustrated is used to describe the technology, detailed structural characteristics and operation action for the present invention.

DETAILED DESCRIPTION OF THE INVENTION

Figure 1:
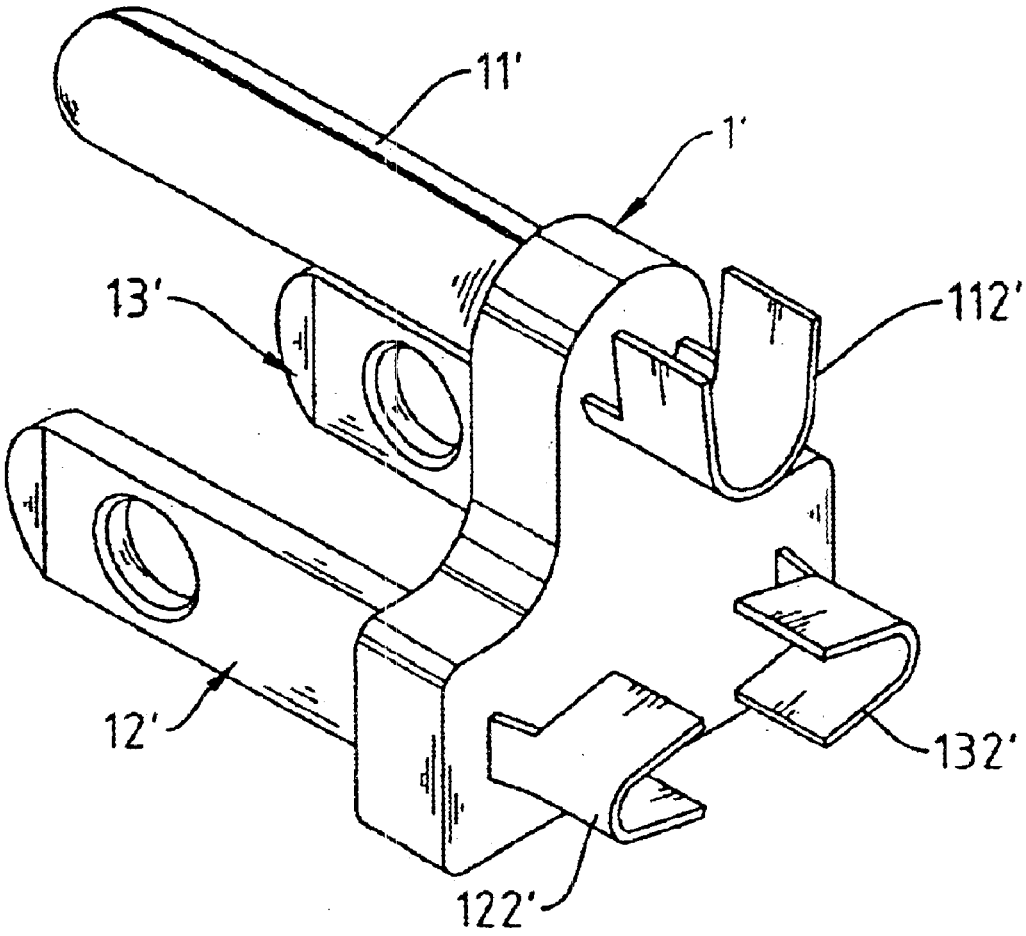
FIG. 1 Prior Art
FIG. 1 is the diagram about the appearance of traditional plugs.
Figure 2:
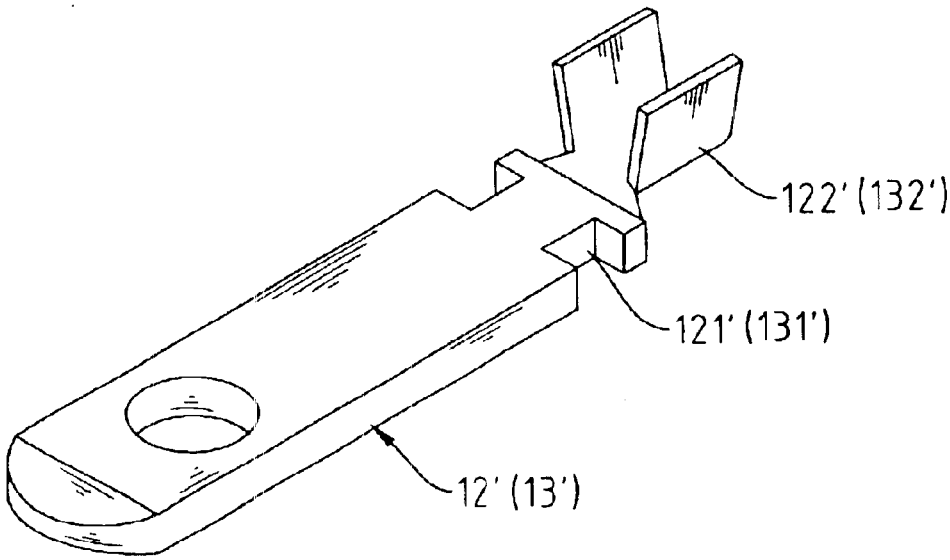
FIG. 2 Prior Art
FIG. 2 is the diagram about the appearance of traditional rectangle conductive sheetmetals.
Figure 3:
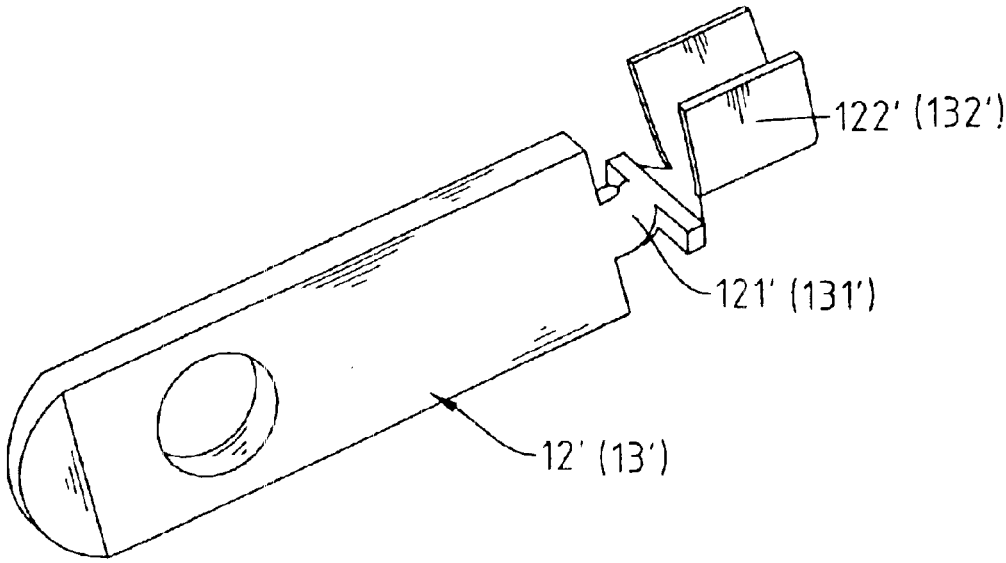
FIG. 3 Prior Art
FIG. 3 is the diagram about the appearance of traditional rectangle conductive sheetmetals whose extended sheetmetals are twisted and thus the opening of the wire-inlaying ends are veered around.
Figure 4:
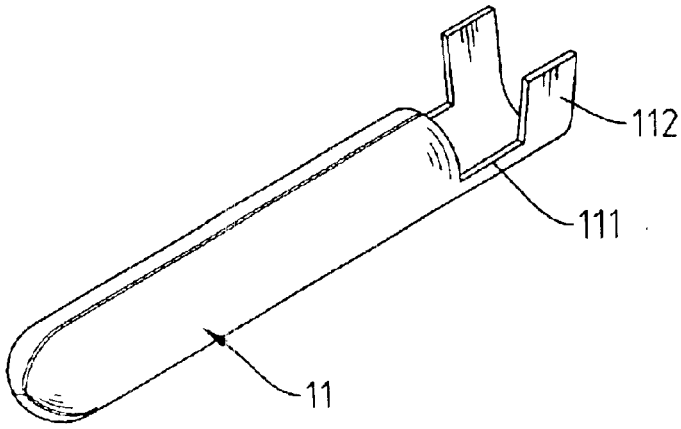
FIG. 4 is the diagram about the appearance of the round-headed conductive sheetmetal for the present invention.
Figure 5:
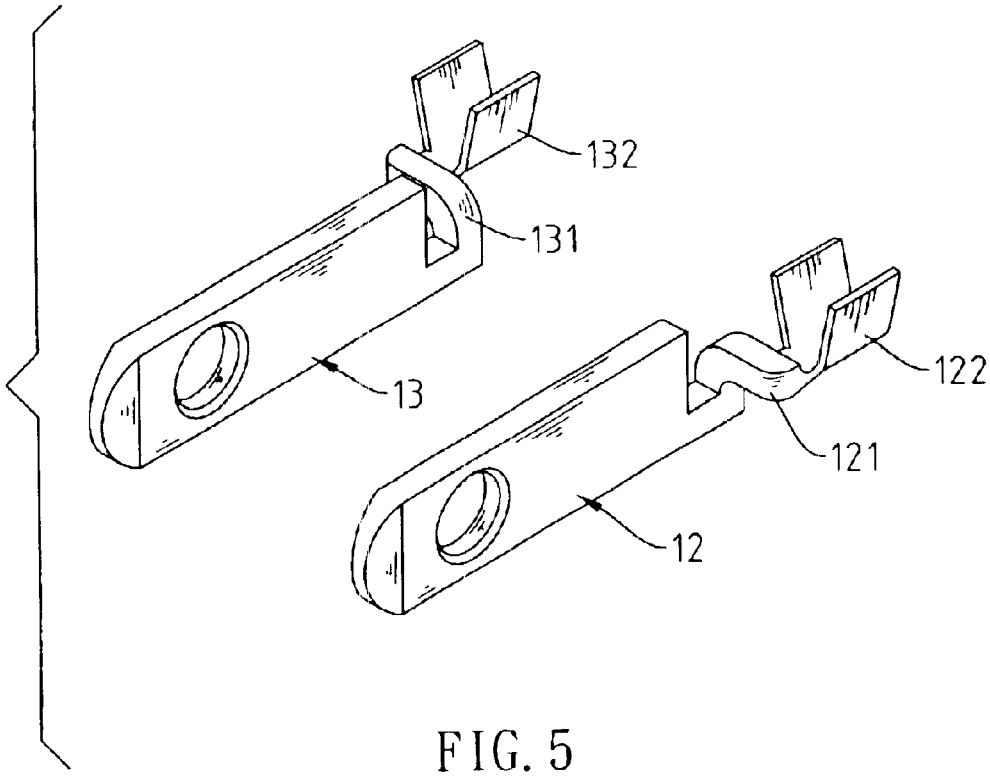
FIG. 5 is the diagram about the appearance of the two rectangle conductive sheetmetals for the present invention.

Please refer to FIGS. 4 and 5. The conductive sheetmetals for the present invention consist of one copper round-headed conductive sheetmetal 11 and two rectangle conductive sheetmetals 12, 13. The round-headed conductive sheetmetal 11 is punched directly in one piece with its backend stretched out to form the extended sheetmetal 111 and the wire-inlaying end 112 with an upward opening. The two rectangle conductive sheetmetals 12, 13 are punched directly in one piece with their backends stretching out and extending upward to form a seamless L-shaped extended sheetmetals 121, 131. The backend of the extended sheetmetals 121, 131 is connected with the wire-inlaying ends 122, 132 with the opening upward.

Figure 6:
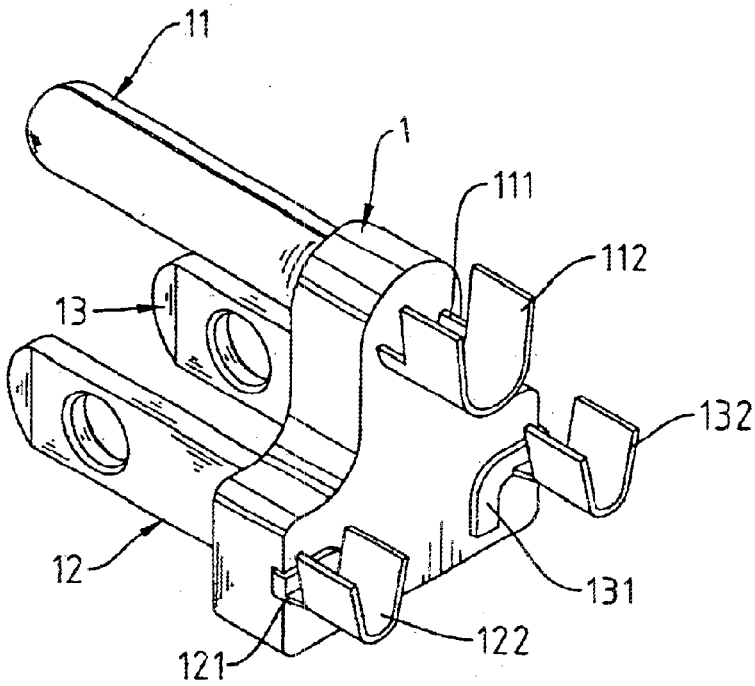
FIG. 6 is the diagram about the appearance of the wrapped and located conductive sheetmetals of the plug for the present invention.
Figure 7:
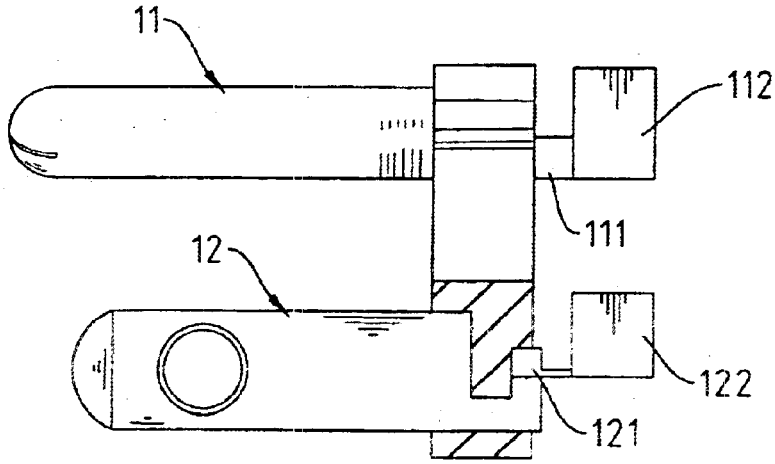
FIG. 7 is the diagram about the cross-section of the plug for the present invention.

Please refer to FIG. 6. The round-headed conductive sheetmetal 11 and the two rectangle conductive sheetmetals 12, 13 for the present invention are wrapped by the resin to form a plug 1, in which the round-headed conductive sheetmetal 11 is located on the upper part of the plug 1 and the two rectangle conductive sheetmetals 12, 13 are located on the lower part of the plug 1 in parallel to form a plug 1 with the three conductive sheetmetals in triangle. Meanwhile, the opening of the wire-inlaying end 121 for the round-headed conductive sheetmetal 11 and the opening of the wire-inlaying end 122, 132 for the rectangle conductive sheetmetals 12, 13 are kept upward in parallel. The extended sheetmetal 111 of the round-headed conductive sheetmetal 11 and the extended sheetmetals 121, 131 of the two rectangle conductive sheetmetals 12, 13 are wrapped with the resin that fixes the round-headed conductive sheetmetal 11 and the two rectangle conductive sheetmetal 12, 13, allowing them to prop when being plugged into the outlet (as shown in FIG. 7).

The one-piece extended sheetmetal 121, 131 of the two rectangle conductive sheetmetals 12, 13 are seamless, different from the extended sheetmetals 121', 131' of traditional rectangle conductive sheetmetals 12', 13' that are bended after being shaped. The one-piece extended sheetmetals 121, 131 for the present invention are prevented from the damage caused by the second twist to the material, thus the integrity of the entire rectangle conductive sheetmetals 12, 13 is preserved and the possibility of deficiencies produced is reduced.

Furthermore, the extended sheetmetals 121, 131 wrapped and fixed by the resin allow it to provide a certain degree of support when being plugged into the outlet as well as eliminate the possibility of overheat conductive sheetmetals and over-high resistance, thus fits into with the security regulations for plugs and provides high practicability. In addition, the wire-inlaying end 112 of the round-headed conductive sheetmetal 11 and the wire-inlaying ends 122, 132 of the two rectangle conductive sheetmetals 12, 13 protruding forward from the back of the plug 1 are arranged in the same direction, allowing the wire inlaying operation to be completed once, which in turn reduces the processing, enhances the performance of quota production and cuts down manufacturing cost.

What is claimed is:

1. A plug with a casing comprising:

a) a round connector having:

i) a round-head conductive sheet metal first end protruding from a first side of the casing;

ii) a wire-inlaying second end having a first opening and protruding from a second side of the casing, the second side being opposite the first side, wherein the first opening faces in a predetermined direction; and iii) an extended sheet metal middle portion having a curved cross section and being located between and connecting the round-head conductive sheet metal first end and the wire-inlaying second end, and positioned in the casing; and b) two rectangular connectors, each rectangular connector having:

i) a rectangular conductive sheet metal first end protruding from the first side of the casing;

ii) a wire-inlaying sheet metal second end having a second opening and protruding from the second side of the casing, wherein the second opening faces in the same predetermined direction as the first opening; and iii) a seamless, L-shaped, extended sheet metal middle portion located between and connecting the rectangular conductive sheet metal first end and the wire-inlaying sheet metal second end, and positioned in the casing, wherein the round connector and the two rectangular connectors are spaced apart and protrude through each of the first side and the second side of the casing in a triangular configuration, the round connector is located in an upper part of the casing, and the two rectangular connectors are positioned in parallel in a lower part of the casing;

wherein the L-shaped sheet metal middle portion has a radius segment that is parallel with and partially inset into the second side of the casing and extends to an outer side of the casing.

* * * * *